United States Patent [19]

Leopold

[11] 4,116,335

[45] Sep. 26, 1978

[54] FOLDING LINER FOR SHIRTS AND OTHER PACKAGED GARMENTS

[76] Inventor: Leo Leopold, Austrasse 65, 7140 Ludwigsburg, Fed. Rep. of Germany

[21] Appl. No.: 777,519

[22] Filed: Mar. 14, 1977

[30] Foreign Application Priority Data

Mar. 18, 1976 [DE] Fed. Rep. of Germany ..... 2611406
Jan. 14, 1977 [DE] Fed. Rep. of Germany ..... 2701501

[51] Int. Cl.[2] ..... B65P 85/18

[52] U.S. Cl. ..... 206/492; 206/297; 223/71; 229/87 S

[58] Field of Search ..... 206/292, 295, 296, 297, 206/298, 299, 278, 492, 495; 229/75, 84, 87 A, 87 S, DIG. 3, DIG. 4; 2/117, 255; 223/66, 71, 87, 84, 83

[56] References Cited

U.S. PATENT DOCUMENTS

| | | | |
|---|---|---|---|
| 1,115,169 | 10/1914 | Cahn | 223/71 |
| 1,133,522 | 3/1915 | Wordingham | 229/DIG. 3 |
| 1,140,407 | 5/1915 | Shapiro | 223/71 |
| 2,068,006 | 1/1937 | De Frances | 229/87 S |
| 2,110,480 | 3/1938 | Barlow | 229/DIG. 4 |
| 2,146,052 | 2/1939 | Blumenstock | 223/71 |
| 2,175,666 | 10/1939 | Lighter | 229/87 S |
| 2,204,419 | 6/1940 | Lighter | 229/87 S |
| 2,685,403 | 8/1954 | Glazer et al. | 229/87 S |
| 2,791,369 | 5/1957 | Paige | 229/DIG. 4 |
| 2,974,837 | 3/1961 | Boehmer | 206/292 |

FOREIGN PATENT DOCUMENTS 1,925,115 11/1970 Fed. Rep. of Germany.

*Primary Examiner*—William Price
*Assistant Examiner*—Bruce H. Bernstein
*Attorney, Agent, or Firm*—Joseph A. Geiger

[57] ABSTRACT

A folding liner of cardboard for men's shirts, women's blouses, and like garments, which are folded into a flat package for shipment and display, the liner having a pair of inwardly foldable wing panels adjoining each longitudinal side of the center panel, lateral fold lines between the inner wing panels and the center panel, and intermediate fold lines between the inner wing panels and outer wing panels, whereby a portion of the inwardly folded sleeves of the garment is clamped by the outer wing panels, as they are folded over the inner wing panels, so as to dispense with fastening pins or edge clamps. The inner wing panels include a flap-type or hook-type closure which holds the wing panels in their folded position. Special panel shapes and cutouts facilitate the folding operation or provide liner-free areas on the package.

16 Claims, 21 Drawing Figures

Fig.6.
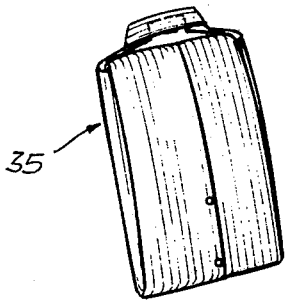
Fig.7.
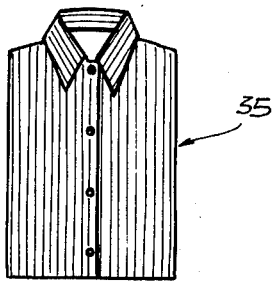
Fig.8.
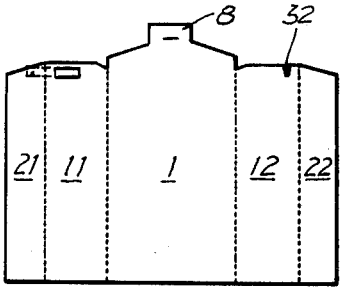
Fig.9.
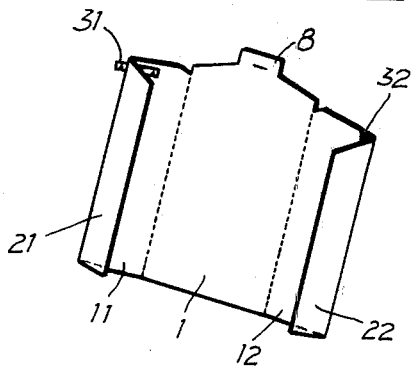
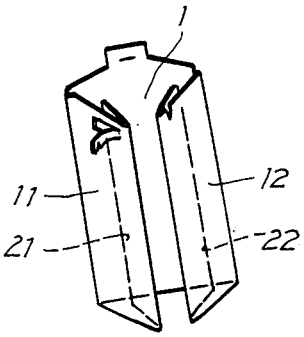
Fig.10.
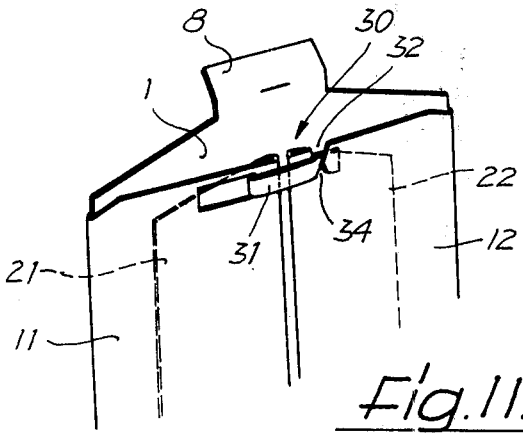
Fig.11.

FOLDING LINER FOR SHIRTS AND OTHER PACKAGED GARMENTS

BACKGROUND OF THE INVENTION

1. Field of the Invention

The present invention relates to garment packaging and display accessories, and, more particularly, to disposable liner panels for outer garments, such as men's shirts, women's blouses, and the like, which are folded into flat packages for purposes of transportation, storage, and sales display.

2. Description of the Prior Art

It is common practice among manufactueres of men's shirts, women's blouses, and similar outer garments, to package the finished garments for storage and sales display by the retail trade in such a way that the particular garment is folded over and attached to a supporting panel or liner of cardboard. The folded garment is in most cases inserted into a bag or shallow carton of which at least the upper side is transparent, so as to display the front side of the article of clothing.

In the course of folding the garment over its cardboard liner, those portions which overlap each other on the back side of the liner are attached to each other and/or to the liner by means of fastening pins, or by means of flexible clamps, so as to hold the front of the garment even and taut against the cardboard liner. In certain configurations, particularly those using a single-panel liner of dimensions equal to the width of the folded garment, only pins are used as fasteners, the pins being inserted through the fabric of the garment, while some of them are stuck into the cardboard liner itself. These fastening pins must later be removed by the buyer of the garment, when he unpacks it for use. While the removal of the pins from the folded garment entails a certain risk of damage to the garment itself, the pins represent a risk of injury, both at insertion in the factory and at removal after purchase. An additional risk is created by pins which accidentally remain in the garment when it is first worn. Lastly, the process of inserting the pins in the course of the packaging operation is timeconsuming and therefore costly.

In an effort to eliminate at least some of the aforementioned disadvantages, there has already been suggested a multi-panel garment liner consisting of a center panel with laterally attached wing-like panels, two lines of perforations defining longitudinal fold lines between the center panel and the adjoining wing panels. The maximum width of the wing panels of this prior art folding liner is approximately one-half of the width of the center panel. It has further already been suggested that the wing panels may have either parallel sides, or that they may have a tapered shape, with a minimum width at the bottom side of the liner and a maximum width at the top side, which is the collar side of the liner. Such a folding liner is disclosed in the German Auslegeschrift No. 15 60 117.

This prior art folding liner makes it possible to dispense with at least some of the previously necessary fastening pins, as clamps may be used to attach to the wing panels those portions of the garment which are folded around their outer longitudinal edges. Even in cases where all the pins are replaced with such clamps, the latter still require the labor of attaching them at the proper places during assembly and their removal by the buyer, prior to use. These clamps have the additional disadvantage of creating undesirable local folds and wrinkles in the garment.

SUMMARY OF THE INVENTION

Underlying the present invention is the primary objective of devising an improved multi-panel folding liner for outer garments, such as men's shirts, women's blouses, and the like, which can be assembled without requiring any of the previously mentioned fastening pins or clamps, or other fastening devices.

The present invention proposes to attain this objective by suggesting a folding liner with five constituent panels, a pair of wing panels adjoining each longitudinal side of a generally rectangular center panel. In the preferred embodiments, the longitudinal sides of the center panel are defined by lateral fold lines between the center panel and the adjoining inner wing panels, and the longitudinal outer sides of the inner wing panels are defined by intermediate fold lines between the inner wing panels and the outer wing panels.

Such a folding liner, when placed with its front side against the back of a garment, is as wide, or almost as wide, as the latter. Accordingly, when the sleeves are folded back over the liner, the subsequent inward folding of the outer wing panels creates a clamping action between the inner and outer wing panels against the overlying portion of the sleeve, so that the front side of the garment is held even and taut against the folding liner, without the use of any fasteners. Conversly, the unfolding of the folding liner immediately releases the garment.

The invention further suggests a way in which the sleeve-clamping action of the outer wing panels can be improved, when the outer wing panels are made narrower than the inner wing panels, the width of the latter being preferably close to one-half the width of the center panel.

By way of a further improvement, the invention also suggests that the fold lines between the inner wing panels and the outer wing panels be oriented to converge in the downward direction, while the fold lines between the center panel and the two inner wing panels are parallel, so that the folded garment, in its portion below the folding liner, is somewhat narrower than in its portion surrounding the folding liner, thereby facilitating the refolding and insertion of the liner-free garment portion under the folded wing panels.

As an alternative to, or in addition to, the convergence of the intermediate fold lines between the wing panels, it is also possible to provide the folding liner with converging outer longitudinal sides on the outer wing panels, whereby the sides of these outer wing panels may be either parallel or appropriately tapered, in order to produce the desired folded configuration.

A preferred embodiment of the invention further includes cutouts in the several panels of the folding liner which, in the folded and assembled state, create liner-free portions, where the fabric "feel" and density can be examined, without touching the liner. These cutouts may be so arranged that the liner-free areas include a length portion of the lateral edges of the assembly, or they may be so arranged that the liner-free areas are located within the borders of the folded assembly.

The present invention proposes still another advantageous modification, inasmuch as it is suggested that the bottom side of the folding liner, rather than being composed of straight, aligned bottom sides of the various panels, include inclined bottom sides on both the inner and outer wing panels, so as to create shortened, upwardly recessed intermediate fold lines between the inner and outer wing panels. The result of this configuration is a reduced bulging tendency of the garment, when its liner-free lower portion is refolded upwardly over the main portion of the assembly. This feature is particularly advantageous in connection with garments which are more than twice as long as the folding liner, in which case the liner-free portion of the garment is preferably refolded over the previously folded wing panels as a last step, and the upwardly overhanging garment extremity is tucked under the upper end portions of the wing panels.

Lastly, the present invention features an integral flap-type or hook-type closure on the inner wing panels which, in the folded condition, locks the inner wing panels against each other in one embodiment, or locks the inner wing panels against the center panel in another embodiment.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows:

FIGS. 6 and 7 show the combination of FIG. 2, following completion of the folding operation, as seen from the back and front, respectively;

FIGS. 8 through 11 show the folding liner of FIGS. 1 and 2, without the garment, in the successive folding stages which are shown in FIGS. 2–5;

DESCRIPTION OF THE PREFERRED EMBODIMENTS

Figure 1:
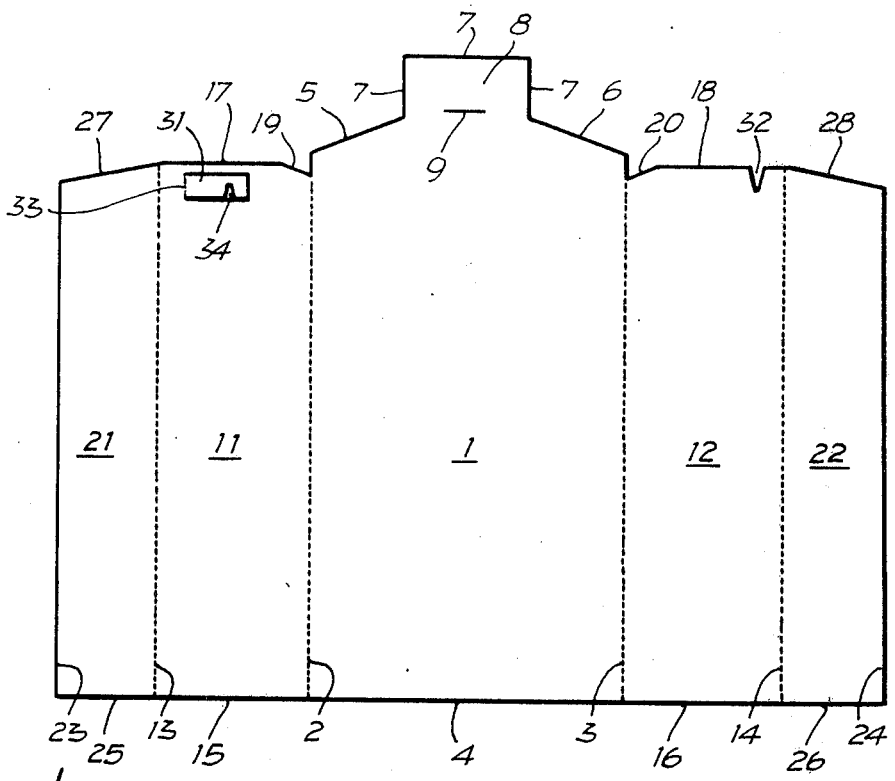
FIG. 1 shows a flat open folding liner, representing a first embodiment of the invention, as adapted for use with men's shirts, for example.

A first embodiment of the invention is shown in FIG. 1. It consists of a folding liner having a center panel 1 whose outline is defined by two parallel lateral fold lines 2 and 3, by a straight bottom side 4, cut at right angles to said lateral fold lines, and by a shaped top side. The latter consists of two oppositely slanting top side cuts 5 and 6 and a central merlon-shaped top side cut 7. The slanting top side cuts 5 and 6 form an obtuse angle with their respective lateral fold lines, extending inwardly from the latter by approximately one-third of the width of the center panel. The merlon-shaped top side cut 7 encloses a rectangular panel area which extends upwardly from the center panel 1 to form an integral collar support 8.

At the base of the collar support 8 is arranged a central incision 9 which is located a small distance above a connecting line between the points where the slanting top side cuts 5 and 6 meet the vertical portions of the merlon-shaped top side cut 7. The incision 9 is a simple cut, reaching over approximately one-third of the width of the collar support 8. It facilitates the necessary bending of the collar support 8 at its base, in alignment with the collar, while maintaining the collar portion 8 safely attached to the center panel 1.

Extending laterally on both sides of the center panel 1 are two inner wing panels 11 and 12 which are joined to the center panel 1 at its lateral fold lines 2 and 3. The two inner wing panels 11 and 12 have matching elongated rectangular outlines, the width of each inner wing panel being approximately 1 mm less than one-half of the width of the center panel 1. The height of the inner wing panels is approximately 1 cm shorter than the height of the center panel 1 at its lateral fold lines 2 and 3. While the inner longitudinal sides of the wing panels 11 and 12 are formed by the lateral fold lines 2 and 3 of the center panel 1, their outer longitudinal sides are formed by parallel intermediate fold lines 13 and 14, respectively. The bottom sides 15 and 16 of the inner wing panels are straight extensions of the bottom side 4 of the center panel 1. The top sides 17 and 18 of the inner wing panels are likewise straight lines, cut at right angles to the longitudinal fold lines. At their inner extremities, however, the inner wing top sides 17 and 18 have inwardly slanting corner cuts 19 and 20, respectively, forming triangular notches which point in the direction of the lateral fold lines 2 and 3. These slanting corner cuts start approximately 15 mm from the lateral fold lines 2 and 3. The angle of the slanted corner cuts 19 and 20 is of approximately the same magnitude as the angle of the slanting top sides 5 and 6, but oriented in the opposite direction, for later parallel alignment, after folding. The purpose of these corner cuts 19 and 20 is to facilitate the folding of the garment at these places, free of distortions and wrinkles.

In addition to the previously described inner wing panels 11 and 12, the proposed folding liner further includes two outer wing panels 21 and 22 which extend from the intermediate fold lines 13 and 14 of the inner wing panels 11 and 12. The outer longitudinal sides 23 and 24 of the two outer wing panels 21 and 22 are also the outer longitudinal sides of the folding liner. The outer wing panels 21 and 22 have the space of an elongated quadrangle with parallel long sides, straight bottom sides 25 and 26, respectively, forming an extension of the bottom sides 15 and 16 of the inner wing panels, and obliquely cut outer wing top sides 27 and 28, respectively. The width of each outer wing panel is approximately two-thirds of the width of the adjacent inner wing panel. While the attached longitudinal side of each outer wing panel is identical in length to the adjoining inner wing panel, its cut outer longitudinal side is shorter by approximately 7 mm, so that the obliquely cut outer wing top sides 27 and 28 are inclined in approximately the same direction as the slanting top side cuts 5 and 6 of the center panel 1.

The lateral fold lines 2 and 3 between the center panel 1 and the inner wing panels 11 and 12 of the folding liner, as well as the intermediate fold lines 13 and 14 between the inner wing panels 11 and 12 and the outer wing panels 21 and 22, are preferably provided in the form of lines of perforations. To indicate these perforations in FIG. 1, the various fold lines are shown as a succession of dots. Similarly dotted lines in the other figures of the drawing are intended to indicate folding perforations along these lines. As FIG. 1 indicates, the folding perforations extend over the entire length of each fold line.

The entire folding liner thus consists of five adjoining panels with straight parallel longitudinal sides and straight aligned bottom sides, thus defining three sides of a regular rectangle. The fourth side of this rectangle, however, is cut to a specific shape for each panel, as described above. The five panels are thus joined at four parallel fold lines which are suitably perforated, or appropriately creased, thereby facilitating the inward folding of the four wing panels of the folding liner.

The folding liner of FIG. 1 further includes a flap-type closure 30, whose purpose is to lock the folding liner in its folded position, as is illustrated in FIG. 11. The closure 30 consists essentially of a closure flap 31 which is attached to the inner wing panel 11 and which can be bent away from the latter, so as to engage a matching closure notch 32 in the opposite inner wing panel 12. The closure flap 31 is generally rectangular in outline, being approximately 40 mm long and 10 mm high, and spaced approximately 5 mm from the top side 17 of the inner wing panel 11. While the two long sides and the inner short side of the closure flap 31 are defined by a U-shaped cut, the outer short side of the closure flap 31 is formed by a flap folding perforation 33, thus providing a bending hinge about which the closure flap 31 can be folded outwardly. Near the free inner end of the closure flap 31 is further arranged a V-shaped flap notch 34, extending upwardly into the flap from its lower long side to about the middle of the flap height. The flap notch 34 of the closure flap 31 is adapted to engage the closure notch 32 of the inner wing panel 12, the notch 32 being likewise V-shaped, extending downwardly from the top side 18 of panel 12 to such a depth that its pointed bottom portion is at approximately the same level as the pointed top portion of the flap notch 34.

The closure flap 31 is preferably folded outwardly against the outer wing panel 21, before the folding liner is placed onto the garment, so that, when the outer wing panels 21 and 22 are first folded inwardly (FIG. 9), and the inner wing panels 21 and 22 are thereupon likewise folded inwardly (FIG. 10), the closure flap 31 extends towards the flap notch 34 of the inner wing panel 12. By slightly bending the closure flap 31 upwardly, its notch 34 can be engaged into the notch 32 of the wing panel 12.

The preferred material for the folding liner is a duplex-type cardboard stock with a white front side, the weight of the stock being preferably between 300 and 350 p/m$^2$ (0.55 to 0.64 lbs/yd$^2$).

Figure 2:
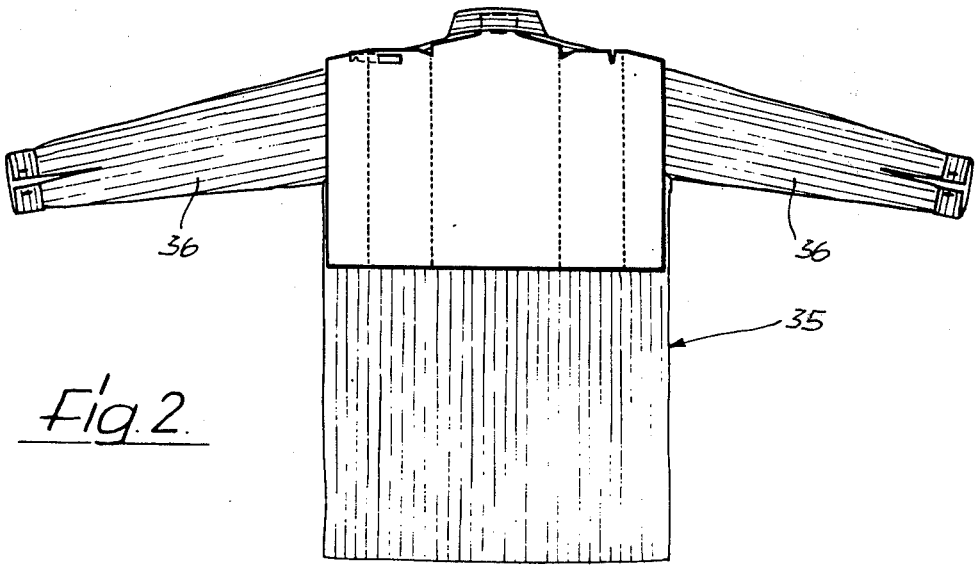
FIG. 2 shows the folding liner of FIG. 1, at a smaller scale, as positioned on the back of a man's shirt, at the start of a folding operation.

FIGS. 2 through 7 of the drawing illustrate the manner in which the folding liner of FIG. 1 and a matching man's dress shirt are assembled into a folded package. The shirt 35 is first placed onto an assembly table (not shown), its front and collar being buttoned up and facing downward, and the table having preferably a suitable depression for the shirt collar. Before the folding liner is placed on top of the stretched-out shirt, its closure flap 31 is folded outwardly on the front side of the liner, as described earlier, and its collar support 8 is bent slightly towards the front side. The collar support is then inserted under the rear of the shirt collar and the folding liner is placed on the back of the shirt, as shown in FIG. 2.

Figure 3:
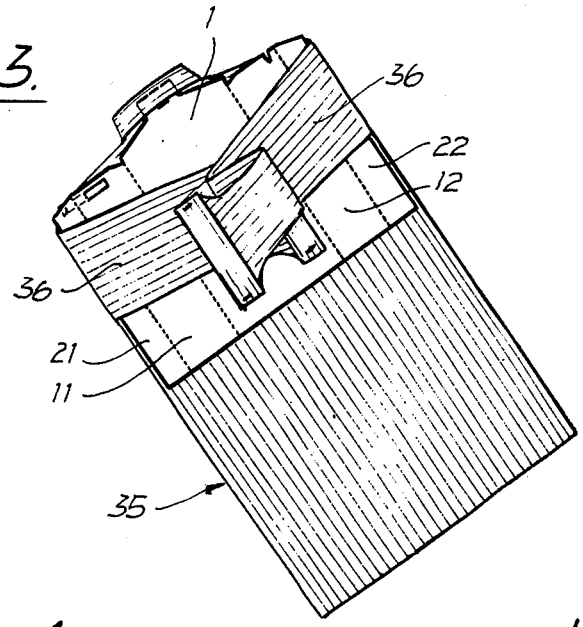
FIGS. 3, 4, and 5 show the liner and shirt combination of FIG. 2 in several successive folding stages, as seen from the back side.

As is shown in FIG. 3, the previously outstretched sleeves 36 of the shirt are now folded inwardly over the still open liner and, depending on the length of the sleeves, are doubled up in the center, so that the flattened cuffs of the sleeves come to lie just inside the lateral borders of the center panel 1. In cases where the shirt is larger in width than the overall width of the open folding liner, the protruding portions of the shirt are folded inwardly over the longitudinal outer edges 23 and 24 of the folding liner, at the same time as the sleeves are folded inwardly.

Figure 4:
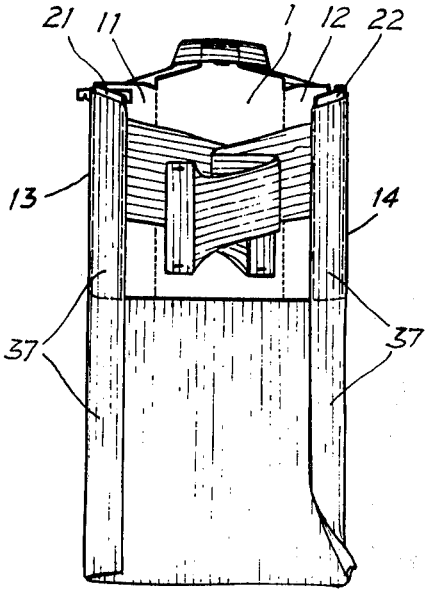

The next folding step is shown in FIG. 4, where the outer wing panels 21 and 22 of the liner are folded inwardly over the inner wing panels 11 and 12, respectively, together with the underlying shirt portions 37. To the extent that the lower length portion of the shirt is not shaped by the folding liner, the fold created by the outer wing panels 21 and 22 naturally creates a continuation of said fold in the liner-free lower shirt portion. A portion of the sleeves 36 and, in the case of an oversized shirt, the initially refolded lateral edge portion of the shirt, is now clamped in the fold between the adjoining inner and outer wing panels. While FIG. 4 shows the continuation of the first fold in the lower shirt portion to be straight and in alignment with the intermediate fold lines 13 and 14, in practice, the absence of a liner in the lower shirt portion tends to create slightly tapering folds which converge towards the bottom end of the shirt.

Figure 5:
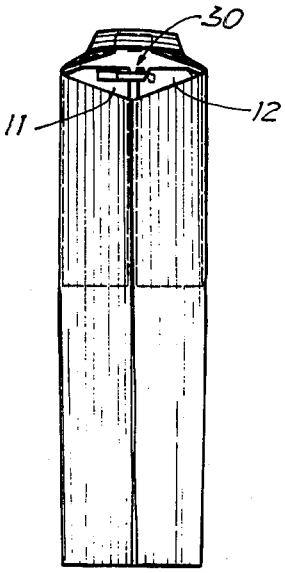

The next folding operation, shown in FIG. 5, involves the inner wing panels 11 and 12, which are folded over the center panel 1 of the folding liner, thereby also folding inwardly underlying shirt portions of equal width, while refolding the previously folded shirt portions against the center panel 1. Again, the liner-free lower shirt portion forms free folds which are substantially a continuation of the liner-controlled folds at the lateral fold lines 2 and 3. At this point, the closure flap 31 of the left-hand inner wing panel 11 extends towards the closure notch 32 of the right-hand inner wing panel 12, so that it can be engaged into the closure notch 32, thereby locking the assembly in the folded position. The liner-free portion of the longitudinally folded shirt is now refolded transversely about the bottom edge of the folding liner, and, to the extent that the liner-free shirt portion is longer than the liner, is tucked back under the folded wing panels, by simply inserting its extremity between the folded wing panels and the center panel 1.

The result of such a folding operation is shown in FIG. 6, the clamping effect of the wing panels against the tucked-under extremity of the shirt holding the assembly together, without fastening pins, clamps, or the like. The completely folded shirt, illustrated in FIGS. 6 and 7, has no protruding sleeves or other loose garment portions, and its front is stretched even and taut over the center panel of the folding liner, so that the shirt can be easily stored and handled. Although the garment could be displayed for sale in this state, it is preferable to place the folded shirt inside a transparent display bag or inside a shallow display carton, which is then closed and which may carry appropriate merchandising information.

In the case of women's blouses, men's sport shirts, and similar garments which have a liner-free lower portion which is shorter than the liner itself, the procedure of tucking the free extremity of the shirt under the folded liner wing panels (FIG. 6) is not possible. These garments require a somewhat different folding step sequence, following the folding stage shown in FIG. 3: After the sleeves have been folded inwardly over the still open folding liner, the garment portion below the liner is refolded over the latter, along its entire width. Now, the wing panels, first the outer ones and then the inner ones, are folded over the back side of the center panel, as previously described, and the closure flap 31 is engaged into the closure notch 32. Again, this closure holds the assembly in a folded state in which it can be handled for storage and shipping, with or without a protective plastic bag or carton.

Figure 12:
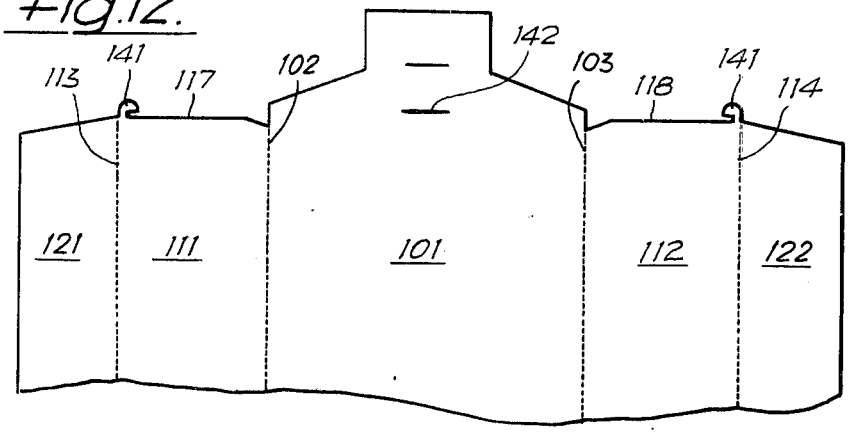
FIG. 12 shows the shaped upper portion of a modified folding liner for men's shirts, representing a second embodiment of the invention.
Figure 13:
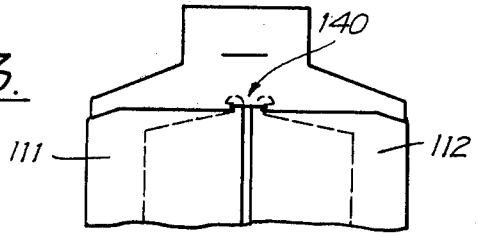
FIG. 13 shows the liner of FIG. 12 in the folded state.

Referring to FIGS. 12 and 13, there is shown a second embodiment of the invention, the suggested folding liner differing from the previously described folding liner (FIG. 1) only inasmuch as the closure for the folded wing panels has been modified. It will be noted that the constituent panels and other features of the embodiment of FIG. 12, to the extent that they are identical or similar to panels and features of the embodiment of FIG. 1, carry reference numerals which differ from the reference numerals of the FIG. 1 embodiment by an added 100-digit. To the extent that features of the embodiment of FIG. 12 are not described hereinbelow, they are unchanged from the corresponding features of the embodiment of FIG. 1.

The closure of the folding liner of FIG. 12, rather than having a folding-flap-type configuration, is a hook-type closure (FIG. 13), consisting of two simple closure hooks 141 which extend upwardly from the inner wing panels 111 and 112 and which cooperate with a closure slot 142 in the center panel 101. The two closure hooks 141 are identically shaped and oppositely oriented hook formations, with an opening facing towards the center panel 101. The outer edge of the closure hook 141 is preferably aligned with the intermediate fold lines 113 or 114, respectively, and the hook opening is preferably a simple horizontal slot of which the lower flank is a length portion of the top side 117 or 118 of the associated inner wing panel 111 or 112, respectively.

In the center panel 101 is provided a cooperating horizontal closure slot 142, in the form of a simple incision which is similar to the incision 9. This closure slot is positioned in alignment with the top sides 117 and 118 of the inner wing panels, and its length is such that both closure hooks 141 can be conveniently inserted through it at the end of the folding operation. Preferably, the length of the closure slot 142 is at least twice the width of a closure hook 141, thereby allowing for some bulging of the folded wing panels to accommodate the multiple thickness of the folded garment. This bulging tendency of the closed assembly provides a convenient spring action on the hook closure 140, so as to maintain the closure hooks 141 safely engaged in the closure slot 142 (FIG. 13).

Figure 14:
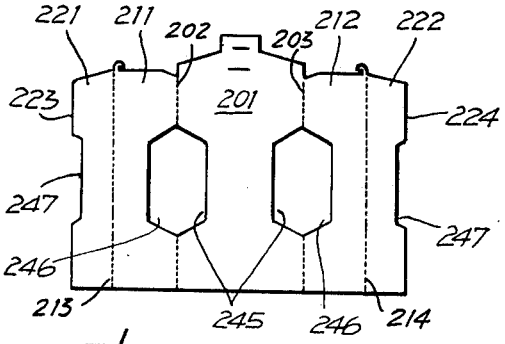
FIG. 14 shows a further modified folding liner for men's shirts, representing a third embodiment of the invention.
Figure 15:
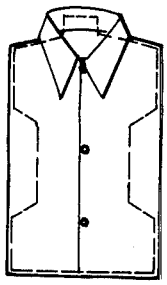
FIG. 15 shows a folded shirt, in combination with the folding liner of FIG. 14.

In FIGS. 14 and 15 is illustrated a third embodiment of the invention, in the form of a modification of the embodiment of FIGS. 12 and 13. While the top and bottom configurations, as well as the width of the five panels and their fold lines, are unchanged from the previously described folding liner, there are several cutouts in the midportion of the folding liner which, in the folded state, form trapezoidal liner-free side portions on the finished assembly, as is shown in FIG. 15. In order to accomplish this end result, the center panel 201, and the adjoining inner wing panels 211 and 212 have matching pairs of trapezoidal cutout portions 245 and 246 which form a mirror image with respect to the lateral fold lines 202 and 203. Similarly, the outer wing panels 221 and 222 also have trapezoidal cutouts 247 which form a mirror image of the cutouts 246 of the inner wing panels 211 and 212 with respect to the intermediate fold lines 213 and 214. To the extent that the outer wing panels 221 and 222 are narrower than the inner wing panels 211 and 212, their cutouts 247 are less deep than the cutouts 246. The long sides of the cutouts are preferably parallel to the long sides of the panels of the folding liner. The purpose of these cutouts is to provide liner-free areas on the made-up garment, where the fabric "feel" and density can be examined, free from intereference by the folding liner, without negatively affecting the even and taut manner in which the front of the garment is presented.

Figure 16:
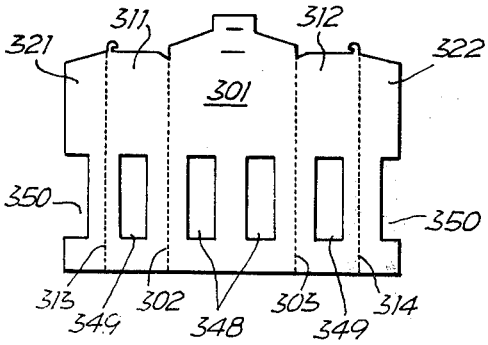
FIG. 16 shows a differently modified folding liner for men's shirts, representing a fourth embodiment of the invention.
Figure 17:
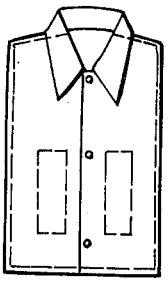
FIG. 17 shows a folded shirt, in combination with the liner of FIG. 16.

The fourth embodiment of the invention, illustrated in FIGS. 16 and 17, represents a similar, but geometrically different modification of the folding liner of FIG. 12, intended for the same purpose as just described in connection with the embodiment of FIGS. 14 and 15. Here, the cutouts in the panels of the folding liner, rather than being trapezoidal in shape and joined at the lateral fold lines, are rectangular in shape and spaced symmetrically from the fold lines. Accordingly, the center panel 301 has two laterally spaced cutouts 348, and the inner wing panels 311 and 312 have each a central rectangular cutout 349, while the outer wing panels 321 and 322 have each an outwardly open cutout 350. The latter is outwardly open, because the outer wing panels are not wide enough to accommodate a full rectangular cutout at the required distance from the intermediate fold lines 313 and 314. It should be understood that, while it is preferable to arrange the cutouts 349 of the inner wing panels 311 and 312 centrally between the associated lateral fold lines and intermediate fold lines, respectively, this is not a limiting requirement. The folded assembly, shown in FIG. 17, thus has two rectangular areas in which the garment layers are free of intermediate liner panels. This type of folding liner may be preferable over the folding liner embodiment of FIGS. 14 and 15, when the material of the garment is very soft or elastic, so that the garment would be drawn in at the laterally open trapezoidal contour recesses of the folded liner of FIG. 15.

Figure 18:
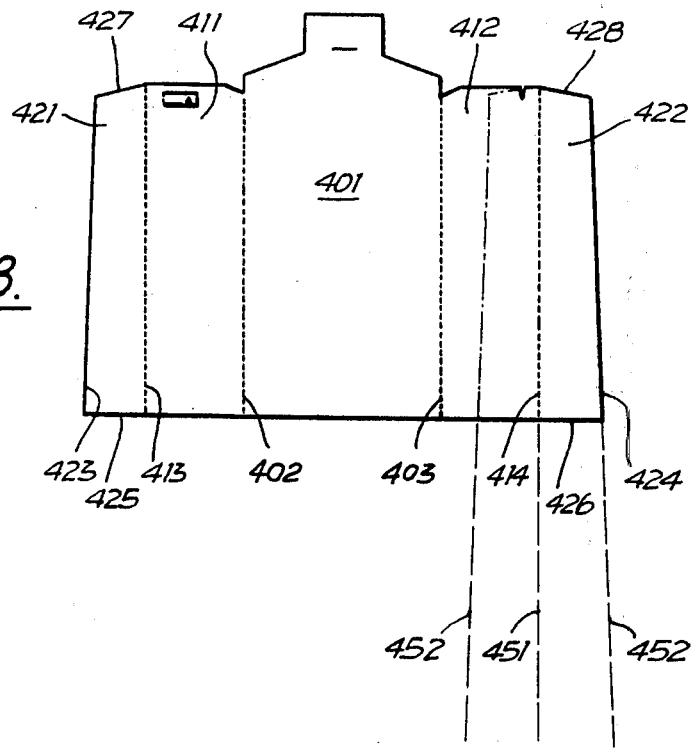
FIG. 18 shows still another modification of the folding liner of FIG. 1 for men's shirts, representing a fifth embodiment of the invention.
Figure 19:
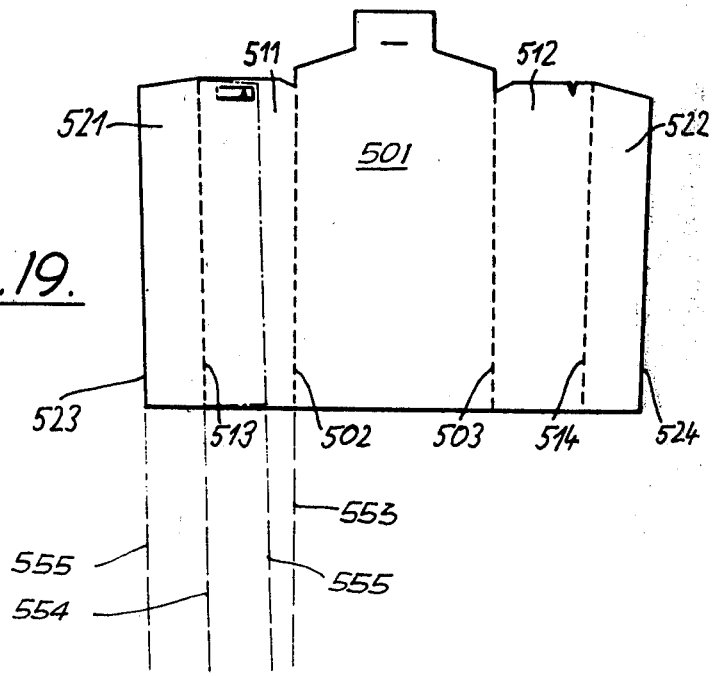
FIG. 19 shows still another modification of the folding liner of FIG. 1 for men's shirts, representing a sixth embodiment of the invention.

FIG. 18 and FIG. 19 illustrate a fifth and sixth embodiment of the invention, in the form of modifications of the embodiment of FIG. 1, the modifications involving in both cases the longitudinal sides of the wing panels. While the configuration of the top side of the folding liner is shown to be the same as that shown and described in connection with FIG. 1, it should be understood that this configuration is given by way of example only and that the novel features of the embodiments of FIG. 18 and FIG. 19 do not require this particular top side configuration. However, to the extent that certain features of the folding liners of FIG. 18 and FIG. 19 are not specifically described, it should be assumed that they are preferably identical to, or similar to corresponding features of the preceding embodiments.

The folding liner of FIG. 18, consisting typically of five panels, has a center panel 401 and two inner wing panels 411 and 412 which are unchanged from the previously described embodiments, meaning that they have parallel longitudinal sides defined by the lateral fold lines 402 and 403 and by the intermediate fold lines 413 and 414. Unlike the outer wing panels of the previously described embodiments, however, the outer wing panels 421 and 422 of FIG. 18 have outer longitudinal sides 423 and 424 which taper upwardly towards the intermediate fold lines 413 and 414. Accordingly, the width of the top sides 427 and 428 of these two wing panels is less than the width of their bottom sides 425 and 426. This signifies that the longitudinal outline, as represented by the dotted extension line 452, is similarly tapered, prior to folding, the outline becoming parallel, at the extension line 451, after the first folding operation at the intermediate folding lines 413 and 414. The inwardly folded position of the outer longitudinal side 424 is indicated by the dotted line 452.

In FIG. 19 is shown still another embodiment of the folding liner which, though very similar to the one shown in FIG. 18, differs from the latter in that the outer wing panels 521 and 522 have parallel longitudinal sides, while the inner wing panels 511 and 512 have a slightly tapered outline. Accordingly, the intermediate fold lines 513 and 514 are no longer parallel to the lateral fold lines 502 and 503. While the overall outline of the embodiment of FIG. 18 has a bottom side which is longer than the top side, the embodiment of FIG. 19 has a shorter bottom side. It will be noted, however, that the position of the inwardly folded outer longitudinal side 523, indicated by line 555, is substantially the same in both embodiments.

It is further possible to combine the features of the embodiment of FIG. 18 with those of the embodiment of FIG. 19, in an embodiment (not shown) in which both the inner wing panels and the outer wing panels have a tapered outline. This would mean that the longitudinal side lines converge downwardly towards the intermediate fold lines, while the intermediate fold lines, in turn, likewise converge in the downward direction towards the lateral fold lines. The angles of convergence are preferably identical for both wing panels.

Generally, the tapered shape of the wing panels of the aforementioned embodiments facilitates the folding of the garment in such a way that the garment portion which extends below the folding liner is folded slightly narrower than the garment portion which underlies the folding liner, so that it is easier to tuck the liner-free garment portion under the folded wing panels, at the end of the folding operation as described further above in connection with FIGS. 5 and 6.

Figure 20:
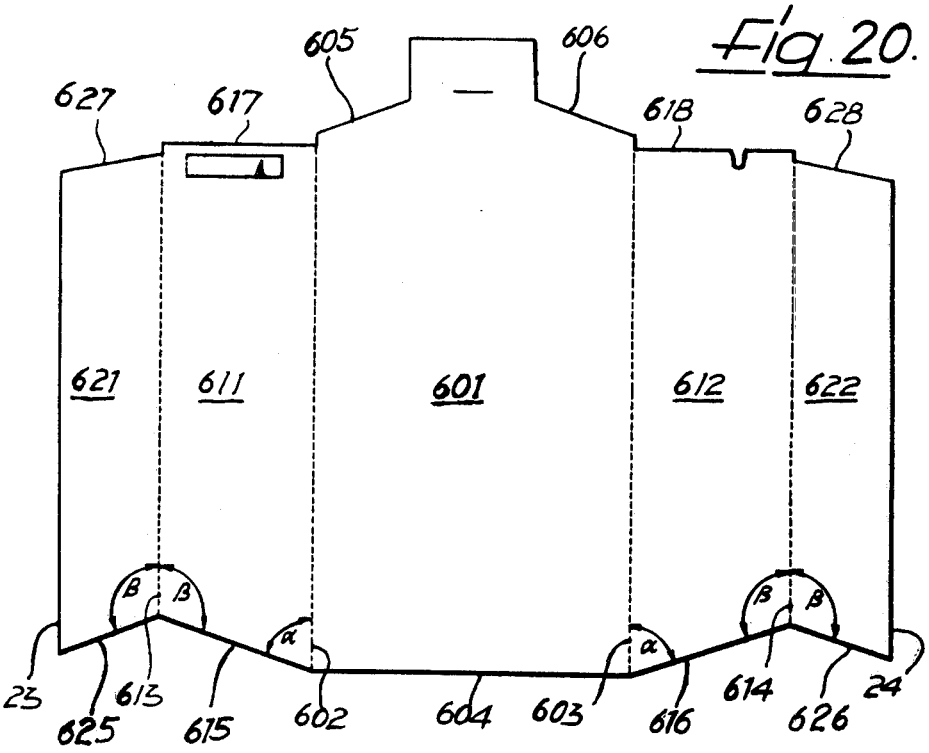
FIG. 20 shows a seventh embodiment of the invention, likewise in the form of a folding liner for men's shirts.
Figure 21:
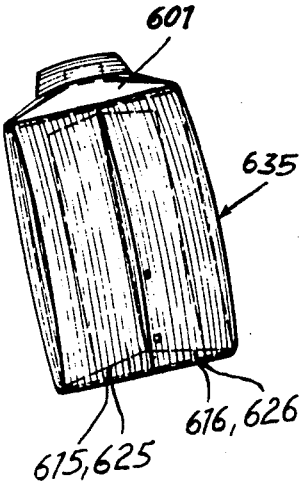
FIG. 21 shows a folded dress shirt, in combination with the folding liner of FIG. 20.

Still another embodiment of the folding liner of the invention is shown in FIGS. 20 and 21. The shape of this folding liner resembles that of FIG. 1, at least with regard to its top side configuration. Only the slanting corner cuts are missing, and the right-angle-cut top sides 617 and 618 of the inner wing panels 611 and 612, respectively, are offset downwardly by approximately 5 mm from the slanting top sides 605 and 606 of the center panel 601. The downwardly slanting top sides 627 and 628 of the outer wing panels 621 and 622, respectively, are likewise downwardly offset from the top sides 617 and 618 of the inner wing panels.

On the other hand, the bottom side of this folding liner is no longer a straight continuous line, the inner and outer wing panels having oppositely inclined bottom sides adjoining shortened intermediate fold lines 613 and 614. In geometrical terms, the bottom sides 615 and 616 of the inner wing panels 611 and 612, respectively, form an acute angle $\alpha$ with the lateral fold lines 602 and 603, while forming an obtuse angle $\beta$ with the intermediate fold lines 613 and 614. The bottom sides 625 and 626 of the outer wing panels 621 and 622, respectively, are preferably inclined by the same obtuse angle $\beta$ from the intermediate fold lines 613 and 614. The angle $\alpha$ is preferably comprised between 70° and 74°, so that the intermediate fold lines 613 and 614 are recessed from an extended bottom side 604 of the center panel approximately 30 mm. The bottom sides of the inner and outer wing panels are preferably arranged to intersect the intermediate fold lines at the same point.

In the folded state, the wing panels of this folding liner have superposed bottom sides (see FIG. 21) which recede inwardly from the bottom side 604 of the center panel 601. The purpose of this configuration is to facilitate the refolding of the liner-free lower portion of the garment 635 over its liner-enveloping upper portion, at the bottom side of the folding liner, the several layers of fabric at this bottom fold being better distributed in the space available. As a result of this, the fold produces less of a buildup, and the final assembly has a more evenly folded and hence more pleasing appearance.

It goes without saying that the configuration of the bottom side of the embodiment of FIG. 20 may be incorporated and combined with any one of the previously described embodiment shapes, particularly with the shape of the embodiment of FIGS. 14 and 15, or with the shape of the embodiment of FIGS. 16 and 17.

It should be understood, of course, that the foregoing disclosure describes only preferred embodiments of the invention that it is intended to cover all changes and modifications of these examples of the invention which fall within the scope of the appended claims.

I claim the following:

1. A folding liner for a man's shirt, or a woman's blouse, or a similar outer garment which is to be assembled with the liner by folding it around the latter into a stiff flat package for purposes of storage, shipment, or retail display, for example, the folding liner comprising in combination:

a substantially rectangular center panel of a width and length which correspond substantially to the width and length of the intended package, the center panel having a bottom side, a top side, and two straight longitudinal sides;

two likewise substantially rectangular inner wing panels having a width slightly less than one-half the width of the center panel and straight longitudinal sides, one longitudinal side of each inner wing panel being the inner side, forming a junction and a lateral fold line with a longitudinal side of the center panel;

two likewise substantially rectangular outer wing panels having a width of at least approximately 5 cm, but less than the width of the inner wing panels, and straight longitudinal sides, one longitudinal side of each outer wing panel being the inner one, forming a junction and an intermediate fold line and with the outer longitudinal side of one of the inner wing panels;

the folding liner thus comprising a succession of five panels which are joined at only four straight fold lines along which the liner material is weakened by perforations, in order for the wing panels to be readily foldable over the center panel, in a configuration in which the outer wing panels lie in-between the inner wing panels and the center panels and in which the liner is capable of clampingly retaining layers of said garment between the inwardly folded outer wing panels and their underlying inner wing panels, on the one hand, and between said folded outer and inner wing panels and the center panel, on the other hand; and closure means for maintaining the folded wing panels in their folded position, said closure means being defined by cooperating closure members which are integral portions of the inner wing panels of the folding liner.

2. A folding liner as defined in claim 1, wherein the width of the outer wing panels is approximately one-third less than the width of the inner wing panels.

3. A folding liner as defined in claim 1, wherein the center panel and the two inner wing panels have parallel longitudinal sides, meaning that the two lateral fold lines and the two intermediate fold lines are parallel.

4. A folding liner as defined in claim 3, wherein the two outer wing panels have longitudinal sides which converge at a small angle from the bottom towards the top of the folding liner.

5. A folding liner as defined in claim 1, wherein the two inner wing panels have longitudinal sides which converge at a small angle from the top towards the bottom of the folding liner.

6. A folding liner as defined in claim 5, wherein the two outer wing panels have parallel longitudinal sides.

7. A folding liner as defined in claim 5, wherein the two outer wing panels have longitudinal sides which converge at a small angle from the top towards the bottom of the folding liner.

8. A folding liner as defined in claim 1, wherein the panels of the folding liner have cutouts which are arranged symmetrically with respect to the fold lines which join the panels, so as to produce at least one liner-free area in the assembled package, where the folded panels have aligned apertures.

9. A folding liner as defined in claim 8, wherein cutouts are arranged in the center panel and in the two inner wing panels, in the form of trapezoidal apertures, the latter being joined at the trapezoid base lines, which coincide with the lateral fold lines, while matching cutouts are arranged in the outer longitudinal edge portions of the two outer wing panels, so that the assembled package has two liner-free areas in the shape of trapezoidal recesses on its longitudinal sides.

10. A folding liner as defined in claim 8, wherein two cutouts are arranged in the center panel and one cutout is arranged in each wing panel, in a symmetrical mirror-image relationship with the four fold lines, so that the assembled package has two liner-free areas which are spaced inwardly from its longitudinal sides.

11. A folding liner as defined in claim 10, wherein the cutouts are rectangular in shape, having longitudinal sides in parallel alignment with te fold lines; and the cutouts are spaced such a distance from the fold lines that the cutouts in the inner wing panels are located approximately at mid-width of the panels.

12. A folding liner as defined in claim 1, wherein each of the two inner wing panels has a bottom side which is inclined, so as to form an acute angle with the associated lateral fold line and a complimentary obtuse angle with the associated intermediate fold line; and each of the two outer wing panels has a bottom side which is likewise inclined, at an angle of substantially equal magnitude, but opposite inclination, so that the bottom lines of each adjoining pair of inner and outer wing panels form a mirror-image with respect to their intermediate fold line.

13. A folding liner as defined in claim 12, wherein the bottom sides of the inner and outer wing panels are straight lines; and the included obtuse angle between each of them and the associated intermediate fold line is comprised between 106 and 110 degrees.

14. A folding liner as defined in claim 1, wherein the closure members of the closure means are arranged near the top sides of the inner wing panels and designed to engage each other without engaging the center panel.

15. A folding liner as defined in claim 14, wherein said closure members include an elongated closure flap on one of the inner wing panels which is cut from said panel and bendable about a bending hinge, so as to extend over the other inner wing panel in the folded position of the liner; and said closure members further include a closure notch in the other inner wing panel, into which the closure flap can be engaged in the manner of a latch.

16. A folding liner for a man's shirt, or a woman's blouse, or a similar outer garment which is to be assembled with the liner by folding it around the latter into a stiff flat package for purposes of storage, shipment, or retail display, for example, the folding liner comprising in combination:

a substantially rectangular center panel of a width and length which correspond substantially to the width and length of the intended package, the center panel having a bottom side, a top side, and two straight longitudinal sides;

two likewise substantially rectangular inner wing panels having a width slightly less than one-half the width of the center panel and straight longitudinal sides, one londitudinal side of each inner wing panel being the inner side, forming a junction and a lateral fold line with a longidutinal side of the center panel;

two likewise substantially rectangular outer wing panels having a width of at least approximately 5 cm, but less than the width of the inner wing panels, and straight longitudinal sides, one longitudinal side of each outer wing panel being the inner one, forming a junction and an intermediate fold line with the outer longidutinal side of one of the inner wing panels;

the folding liner thus comprising a succession of five panels which are joined at only four straight fold lines along which the liner material is weakened by perforations, in order for the wing panels to be readily foldable over the center panel, in a configuration in which the outer wing panels lie in-between the inner wing panels and the center panel and in which the liner is capable of clampingly retaining layers of said garment between the inwardly folded outer wing panels and their underlying inner wing panels, on the one hand, and between said folded outer and inner wing panels and the center panel, on the other hand; and closure means for maintaining the folded wing panels in their folded position, said closure means being defined by closure hooks extending upwardly from an inner wing panel and by cooperating closure slots in the center panel into which the closure hooks are engageable in the folded position of the liner.

* * * * *